US006580879B2

(12) United States Patent
Coleman et al.

(10) Patent No.: US 6,580,879 B2
(45) Date of Patent: Jun. 17, 2003

(54) METHOD AND SYSTEM FOR MANAGING REPLENISHMENT OF TONERS

(75) Inventors: Russell A. Coleman, West Henrietta, NY (US); Joseph W. Ward, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/940,238

(22) Filed: Aug. 27, 2001

(65) Prior Publication Data

US 2003/0044188 A1 Mar. 6, 2003

(51) Int. Cl.[7] ..... G03G 15/08
(52) U.S. Cl. ..... 399/27; 399/28; 399/58
(58) Field of Search ..... 399/27, 28, 58, 399/53; 347/131, 158; 358/1.9

(56) References Cited

U.S. PATENT DOCUMENTS 5,767,886 A * 6/1998 Kawakami et al. ..... 347/115
6,078,762 A * 6/2000 Fuchiwaki et al. ..... 399/92
6,167,214 A * 12/2000 Scheuer et al. ..... 399/27
6,175,698 B1 1/2001 Scheuer et al.
6,275,244 B1 8/2001 Omelchenko et al.

FOREIGN PATENT DOCUMENTS

JP 58-224363 A * 12/1983

* cited by examiner

*Primary Examiner*—Joan Pendegrass
(74) *Attorney, Agent, or Firm*—Nixon Peabody LLP

(57) ABSTRACT

A method and system for the determination of toner usage in proportion to image-feature density, with independent estimation of each color toner module consumption. The system accurately accounts for image-wise color interactions due to color occlusion that may effect the actual amount of toner used by multiple color modules. The method includes a toner replenishment flow control process that responds to the toner consumption/depletion in the developer material (e.g., toner and carrier) as determined by one or more estimation modules, and thus maintains a stable and constant toner/carrier concentration ratio.

29 Claims, 6 Drawing Sheets

METHOD AND SYSTEM FOR MANAGING REPLENISHMENT OF TONERS

FIELD OF THE INVENTION

This invention relates generally to a printing method and system and, more particularly, to a method and system of performing feed-forward toner consumption estimation to manage replenishment of toners during printing.

BACKGROUND OF THE INVENTION

Maintaining stable toner concentration levels is important for maintaining image quality in a printing environment. More specifically, dispensing too little toner because of low toner concentration levels may create areas in a printed image that appear faded, while too much toner may saturate a region in a printed image.

In monochrome (i.e., black and white) printing environments, feedback control systems have been used to regulate toner concentration levels during printing in an attempt to maintain acceptable levels of printed image quality. Typically, these feedback control systems use sensors to measure toner concentration levels in small patches developed during inter-document zones. When the feedback indicates that the toner concentrations levels are too low to maintain an acceptable printed image quality, the toner is mixed with a carrier in the mixing sump until a desired mixture and level is reached.

Although these prior systems work, they have had some problems. One of the problems is the limited sampling period during the inter-document zones which does not provide adequate feedback information about toner concentration levels. As a result, toner concentration levels may actually be too low or too high, but the erroneous condition may not be corrected early enough because of the inaccurate detection and feedback. Another problem is the large lag or delay time between recognizing the need to replenish until the time the toner can be replenished to return the toner concentration level to a nominal state. In fact, in high speed printing systems, sole reliance on a feedback sensor and control system has proven to be marginally stable or unstable in maintaining toner concentration at an acceptably narrow range when many high-density images, demanding considerable toner consumption, are printed. As a result, image quality may suffer until the toner can be replenished.

In color xerography, maintaining stable and accurate toner concentration levels may be more imperative for achieving consistent printed image quality. Poor color balance in printed images may result if toner concentration levels are not maintained at appropriate levels during printing. Further, particularly for image-on-image ("IOI") xerographic color printers, but not limited thereto, the adverse effects caused by improper toner concentration levels are compounded by the IOI interactions of different color separations in the printed images.

Thus, in high speed printing environments, for example, a need exists for metering toner in proportion to image density to anticipate toner consumption in real time to avoid the delays and errors noted above. Furthermore, obtaining a reasonably accurate signal for each color separation in a IOI color printer, for example, would require corrections for interactions between color separations.

SUMMARY OF THE INVENTION

A method for managing replenishment of toners in accordance with one embodiment of the present invention includes determining a quantity of image units for each of one or more colors in a printed image, adjusting each of the quantity of image units based upon one or more color relationships among the one or more colors, and replenishing one or more of the toners when the adjusted quantity of image units for the one or more of the toners indicates a need for replenishment.

A system for managing replenishment of toners in accordance with the present invention includes a quantizing system, an adjustment system, and a replenishment system. The quantizing system determines a quantity of image units for each of one or more colors in a printed image. The adjustment system adjusts each of the quantity of image units based upon one or more color relationships among the one or more colors. The replenishment system replenishes one or more of the toners when the adjusted quantity of image units for the one or more of the toners indicates a need for replenishment.

The present invention provides a number of advantages, including enabling the accumulation of high-definition contone image data at very high data rates and accounting for and correcting color-image interactions and image-wise occlusions during pixel estimation. In addition, the present invention enables toner concentration levels to be maintained at desired levels during color xerography while improving overall image quality.

DETAILED DESCRIPTION OF THE INVENTION

An image path system 10 for maintaining toner concentration levels during printing in accordance with one embodiment of the present invention is illustrated in FIGS. 1–4. Image path system 10 includes digital front end ("DFE") controller 12 coupled to printer controller 13, DFE controller interfaces 14(1)–14(4), therefrom to render units 16(1)–16(4), therefrom to raster output scanners ("ROS") interfaces 18(1)–18(4), therefrom to ROS devices 20(1)–20(4) and to feed forward pixel count ("FFPC") estimation modules 22(1)–22(4). The present invention provides a number of advantages, including enabling the accumulation of high-definition contone image data at very high data rates and accounting for and correcting color image interactions and image-wise occlusions during pixel estimation. In addition, the present invention enables toner concentration levels to be accurately maintained at desired levels during printing and improves overall image quality.

Figure 1:
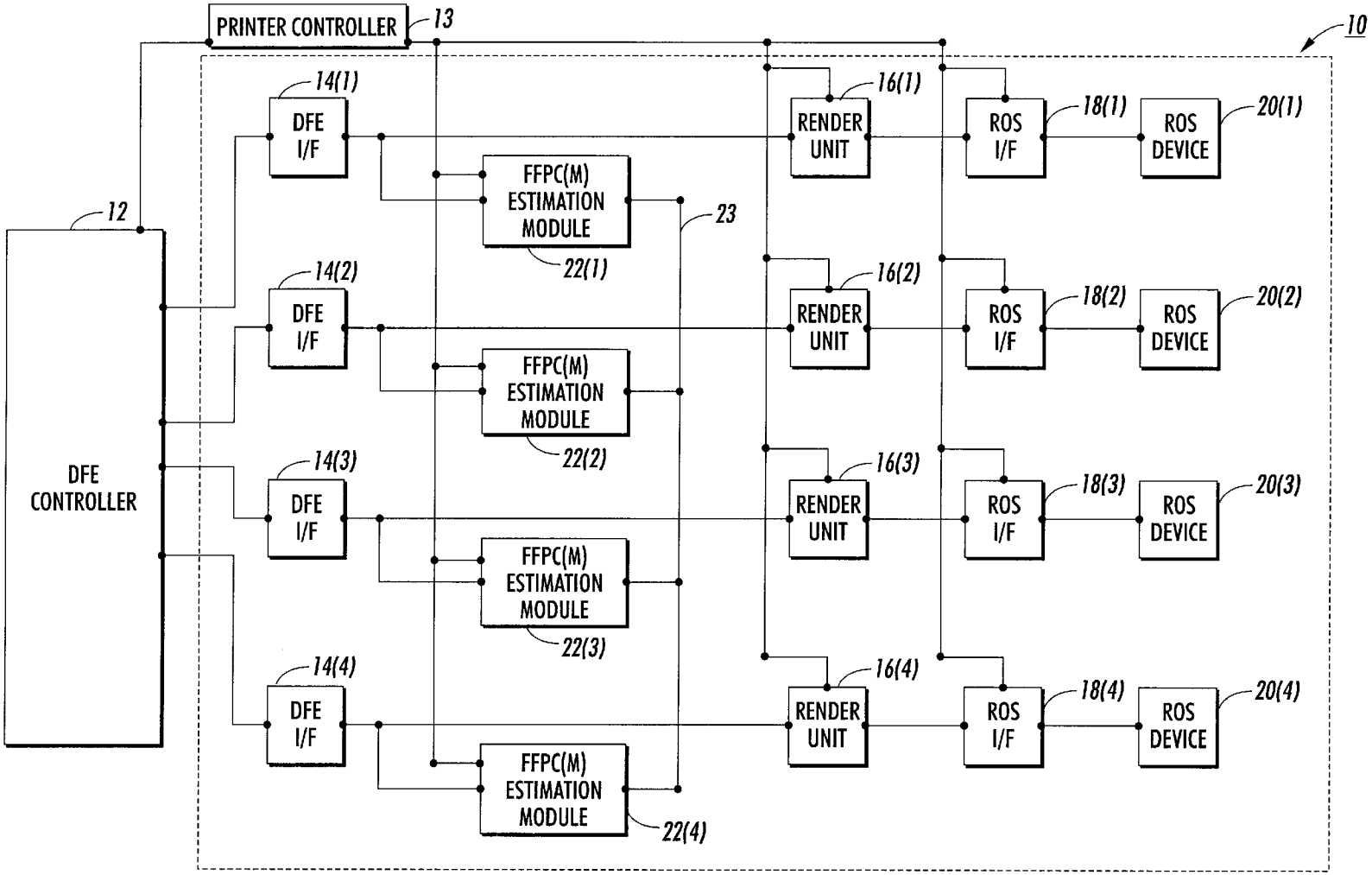
FIG. 1 is a block diagram of a system for performing feed-forward toner consumption estimation during printing in accordance with one embodiment.

Referring more specifically to FIG. 1, DFE controller 12 is coupled to DFE interfaces 14(1)–14(4) and printer controller 13. DFE controller 12 may include one or more processors, circuitry and memory storage devices, which may be coupled together by one or more buses to send video data to image path system 10. In this particular embodiment, DFE controller 12 executes instructions for converting post script files representing images to be printed into contone data to be used by image path system 10, although the image data can be received in other formats and processed in other manners by image path system 10. The contones in this particular embodiment comprise grey scale pixels that represent one of four shades of colors: magenta; yellow; cyan; and black. In other embodiments, contones may represent other colors, such as red, green and blue. Moreover, one or more images to be printed by image path system 10 may be stored in the one or more memory storage devices in DFE controller 12. Further, DFE controller 12 sends contone data to render units 16(1)–16(4), ROS interfaces 18(1)–18(4) and ROS devices 20(1)–20(4) to perform image printing while printer controller 13 maintains toner concentration levels using estimation units 22(1)–22(4) as described further herein.

Printer controller 13 is coupled to DFE controller 12, render units 16(1)–16(4), ROS interfaces 18(1)–18(4), and FFPC estimation modules 22(1)–22(4). Printer controller 13 may include one or more processors, circuitry and memory storage devices, which may be coupled together by one or more buses, to control the image path system 10. The one or more processors may execute a program of stored instructions stored in the one or more memory storage devices for controlling one or more printer devices (not illustrated) and other printing and imaging operations in image path system 10, and for maintaining toner concentration levels during printing in accordance with the present invention as described and illustrated herein. Further, printer controller 13 maintains toner concentration levels using FFPC estimation units 22(1)–22(4) as described further herein. Moreover, in this particular embodiment printer controller 13 is coupled to one or more toner dispensing devices (not illustrated) to cause the toner dispensing devices to replenish one or more toner reservoirs (not illustrated) when interrupts are received by printer controller 13 from one or more FFPC estimation modules 22(1)–22(4), although other configurations and methods can be used to replenish toner.

DFE controller interfaces 14(1)–14(4) are coupled to render units 16(1)–16(4) and FFPC estimation modules 22(1)–22(4). DFE interfaces 14(1)–14(4) may include one or more processors, circuitry and memory storage devices, which may be coupled together by one or more buses, to support the high speed transfer of digital contone image data to image path system 10 with four different color image separations, including magenta, yellow, cyan, and black, for example. Moreover, DFE controller interfaces 14(1)–14(4) enable image data sent from DFE controller 12 to be properly formatted and synchronized upon successive transfers to render units 16(1)–16(4), ROS interfaces 18(1)–18(4), ROS devices 20(1)–20(4) and FFPC estimation modules 22(1)–22(4).

Render units 16(1)–16(4) are coupled to DFE controller interfaces 14(1)–14(4) and ROS interfaces 18(1)–18(4). Render units 16(1)–16(4) may include one or more processors, circuitry and memory storage devices, which may be coupled together by one or more buses to transform, for each color, contone imagewise data into halftoned binary image data on a pixel-by-pixel basis, thus presenting to ROS interfaces 18(1)–18(4) halftoned image patterns that will be needed to print an image representing the original image for each color separation (e.g., magenta, yellow, cyan or black). This binary halftoned image data is sent to ROS interfaces 18(1)–18(4), and is ultimately used by ROS devices 20(1)–20(4) for example, to expose a photo receptor in an image wise fashion during printing.

ROS interfaces 18(1)–18(4) are coupled to render units 16(1)–16(4) and ROS devices 20(1)–20(4). ROS interfaces 18(1)–18(4) may include one or more processors, circuitry and memory storage devices, which may be coupled together by one or more buses, to reformat and resynchronize image data to be used by ROS devices 20(1)–20(4) to write or print images stored in DFE controller 12 as modified by render units 16(1)–16(4). Moreover, ROS interfaces 18(1)–18(4) perform such functions such as turning the ROS devices 20(1)–20(4) on and off and providing the ROS devices 20(1)–20(4) with image pixel data, including pixel arrangements within a scan line and image boundaries during printing, for example.

ROS devices 20(1)–20(4) are coupled to ROS interfaces 18(1)–18(4). ROS devices 20(1)–20(4) may include one or more processors, circuitry and memory storage devices, which may be coupled together by one of more buses, to direct a laser towards a charged xerographic photoreceptor to discharge portions thereof in an imagewise pattern leaving unexposed areas charged during printing.

FFPC estimation modules 22(1)–22(4) are coupled to printer controller 13, DFE controller interfaces 14(1)–14(4) and to each other by the data transfer bus 23, which may comprise a VMEbus, PCI or Sbus type bus, for example. FFPC estimation modules 22(1)–22(4) each include one or more processors, circuitry and memory storage devices, which are coupled together by one or more buses, for estimating total contone counts for each of the toner colors, such as magenta, yellow, cyan, black, red, green, blue, black, gray or white, to dynamically determine toner usage during printing as described in detail further herein.

Figure 2:
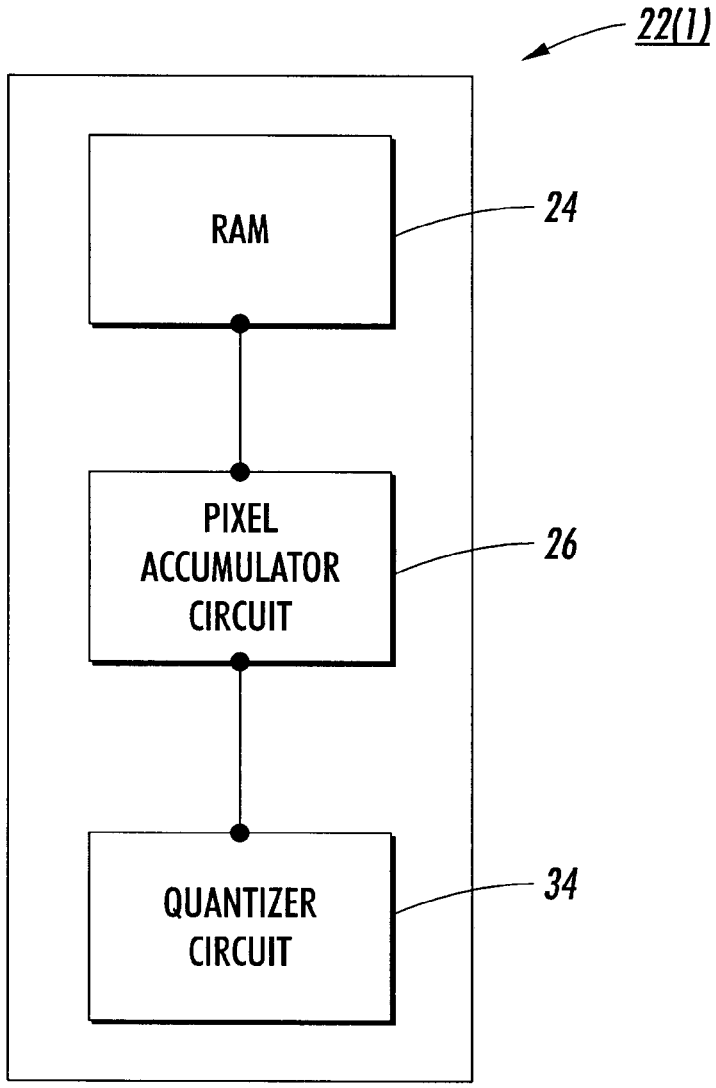
FIG. 2 is a block diagram of a magenta estimation module used in the system for performing feed-forward toner consumption estimation during printing.

Referring specifically to FIG. 2, magenta FFPC estimation module 22(1) includes RAM 24, pixel accumulator circuit 26 and quantizer circuit 34, which are coupled to each other by one or more buses, for analyzing and processing contone tile data received from DFE controller interfaces 14(1)–14(4) to generate and provide to printer controller 13 with interrupts or other signal(s) to indicate when magenta toner is needed to replenish a magenta toner reservoir for maintaining a magenta toner concentration level.

In this particular embodiment, RAM 24 of magenta FFPC estimation unit 22(1) is logically organized in one or more memory sections, although other arrangements can be used. In particular, the one or more logical memory sections may include a program memory location for storing the methods described herein for estimating a total number of magenta contones, an input estimate memory location for storing contone counts obtained from one or more FFPC estimation modules 22(2)–22(4), an output estimate memory module for storing a magenta contone count to be used as necessary by one or more of FFPC estimation modules 22(2)–22(4), and a shared memory section as described further herein. Communication between RAM 24 and printer controller 13 may occur through the shared memory. Contone count estimates calculated by magenta estimation module 22(1) are packed into the output section of RAM 24. Furthermore, a semaphore or mailbox protocol may be constructed to send and receive command and status information. The contone count estimates packed in the output section of RAM 24 may be sent to another one or more of the FFPC estimation modules 22(2)–22(4).

Figure 3:
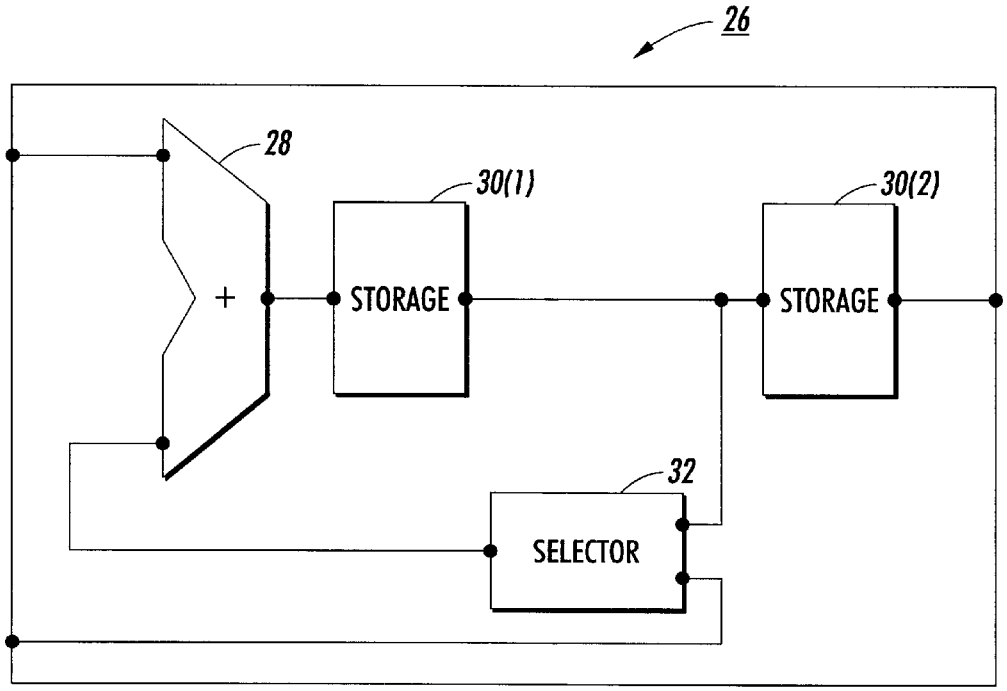
FIG. 3 is a block diagram of a pixel accumulator circuit used in the magenta estimation module.

Referring to FIG. 3, the pixel accumulator circuit 26 may include one or more processors, circuitry and memory storage devices, which may be coupled together by one or more buses, to count the number of magenta contones present in the image being printed. In this particular embodiment, the pixel accumulator circuit 26 includes adder circuit 28, storages 30(1) and 30(2) and a selector 32, which are coupled to each other by one or more buses. Adder circuit 28 is used for summing contone data provided to it. Storages 30(1) and 30(2) store an output value of adder circuit 28, and selector 32 routes the output data from the adder circuit 28 back into adder circuit 28 so that it may be summed with additional contone data as it is received by adder circuit 28. Although one example of a pixel accumulator circuit 26 is shown, other types of circuits or systems could be used. For example, a buffer and a digital signal microprocessor may be used to perform the function of the pixel accumulator circuit 26. In such an embodiment, to avoid running at excessive data bandwidths, the digital signal microprocessor could be programmed to calculate a contone estimate based on every other pixel in the contone tile data. Moreover, in this example, every other pixel would be scaled by a factor of two to accommodate the pixel that was skipped.

Figure 4:
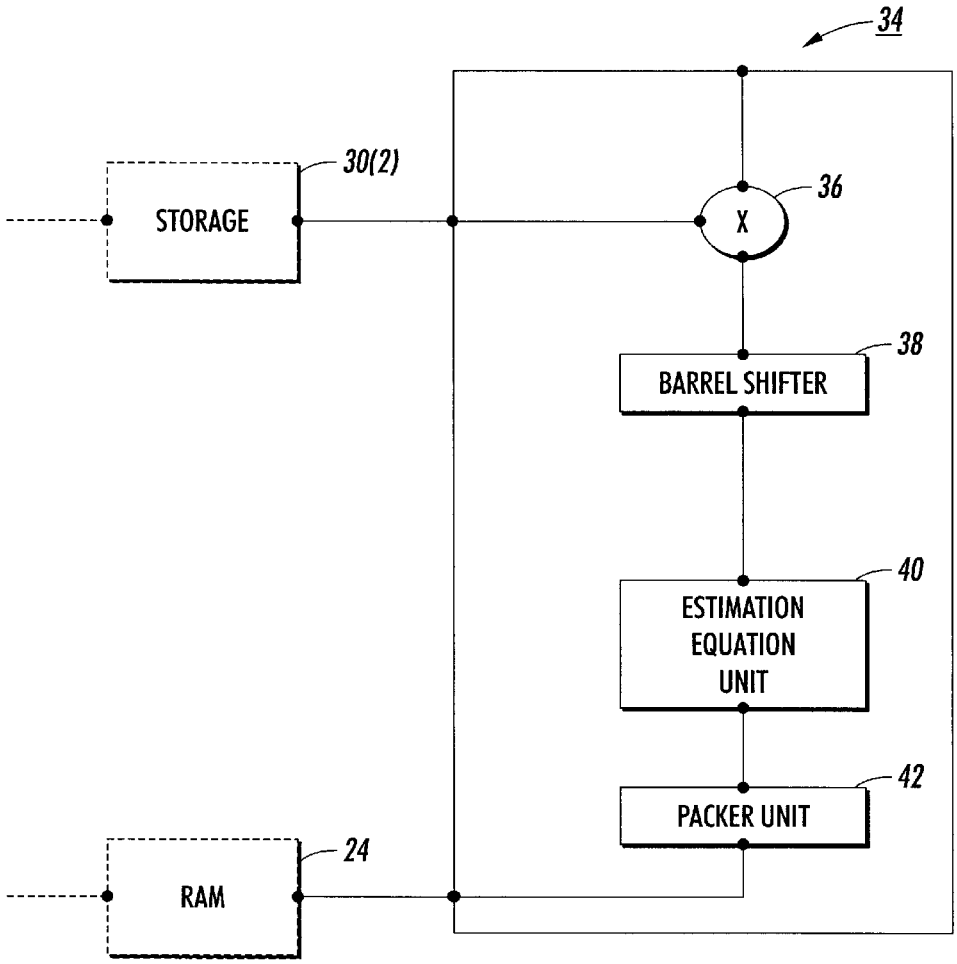
FIG. 4 is a block diagram of a pixel quantizing circuit used in the magenta estimation module.

Referring to FIG. 4, quantizer circuit 34 may include one or more processors, circuitry and memory storage devices, which may be coupled together by one or more buses, to apply the magenta estimation equation to the contone counts performed by pixel accumulator circuit 26. In this particular embodiment, the one or more processors may comprise any processor suited for performing MAC operations, such as a floating point digital signal microprocessor. In particular, quantizer circuit 34 includes a multiplier unit 36, barrel shifter 38, estimation equation unit 42 and packer unit 44, which are coupled to each other by one or more buses. In this embodiment, the buses may transfer 32 bits at a time, although other bus capacities can be utilized, such as 16, 64 or 128 bit capacities. Multiplier unit 36 receives magenta contone data and a magenta $\sigma$ factor to convert the magenta pixel counts into an area coverage. The area coverage is the actual amount of magenta toner required to print all of the magenta contones. The $\sigma$ factor is a constant that converts pixel counts into area coverage. Barrel shifter 38 quantizes the actual coverage values transmitted to it from 32 bits down to 8 bits to realize a data compression ratio of 4:1, for example, although other quantizing ratios may be used where different bus capacities are utilized. Estimation equation unit 40 applies the magenta estimation equation using the quantized results received from the barrel shifter 38 and the applied yellow and black estimation equations stored in RAM 24 as described further herein.

The packer unit 42 receives eight bit values for each of the contone color estimates (i.e., magenta, yellow, cyan and black) and outputs the four estimate values packed into one 32 bit value to RAM 24, thereby reducing the overall data transfer traffic on data transfer bus 23. Additionally, other compression techniques may be used such as Run-Length Coding, Huffman Coding, LZ, JPG or Difference, for example. Thus, a 32 bit sequence representing an estimated area of coverage for one or more contone colors may have the following structure: Emn<31:24>, Eyn<23:16>, Ecn<15:8> and Ekn<7:0>. In this example, bit locations 31-8 are reserved for magenta, yellow and cyan areas of coverage, respectively, while bit locations 7-0 are reserved for the black area of coverage. The results of the packed magenta pixel count values are provided by packer unit 46 to RAM 22. In this particular embodiment, the quantizer circuit 26 further aides the pixel accumulator circuit 26 by retrieving intermediate contone counts (e.g., S1,1:N) from RAM 24 and loading the contone counts on the selector 32. Further, during contone count accumulation, the packer unit 42 is instrumental in storing and retrieving contone counts for the pixel accumulator circuit 26.

In this embodiment, FFPC estimation modules 22(2)–22(4) are the same as magenta FFPC estimation module 22(1) described above, except with respect to their individual operation within image path system 10 as explained further herein below.

Referring to FIGS. 1–6, the operation of image path system 10 for performing feed-forward toner consumption estimation during printing in accordance with another embodiment of the present invention will now be described.

Figure 5:
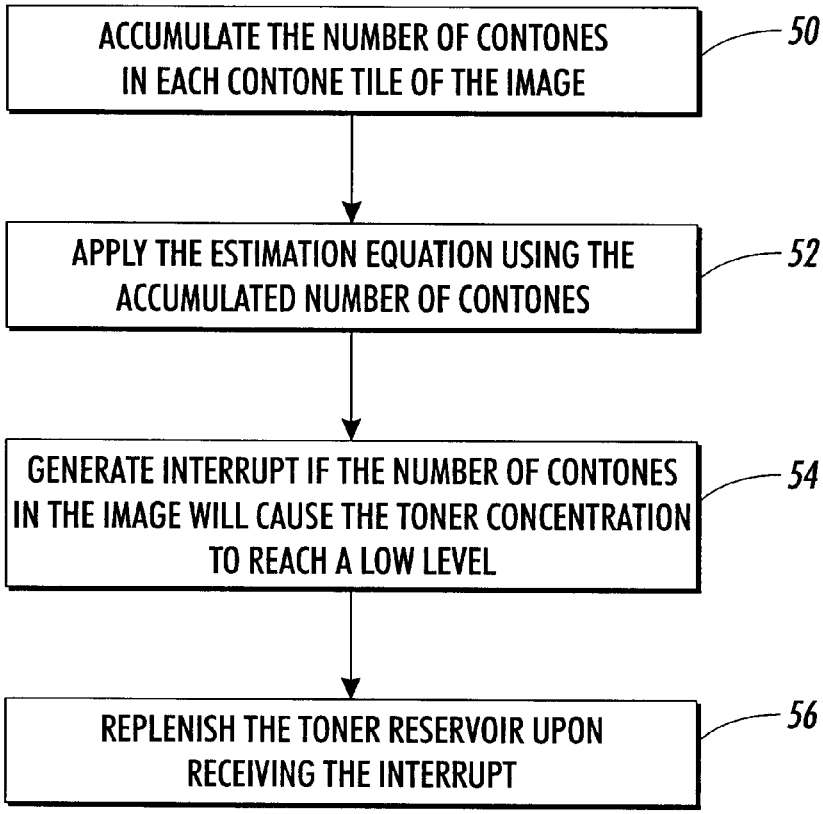
FIG. 5 is a flowchart of a process for performing feed-forward toner consumption estimation during printing in accordance with another embodiment.

Referring to FIG. 5, beginning at step 50, pixel accumulator 26 accumulates the number of contones in an image being printed. As images stored in DFE controller 12 are output by ROS devices 20(1)–20(4), the pixel information is sent to FFPC estimation modules 22(1)–22(4). As a photoreceptor travels through a printing mechanism (not illustrated), the photoreceptor sequentially passes under each of ROS devices 20(1)–20(4). In this embodiment, the photoreceptor first passes under ROS device 20(1) (i.e., magenta), although it may first pass under any of the other ROS devices 20(2)–20(4). ROS device 20(1) receives image data from ROS interface 18(1) instructing it to direct a laser beam towards the previously charged photoreceptor, leaving it charged in an imagewise pattern at locations on the photoreceptor where the magenta toner belongs for the particular image being printed.

Figure 6:
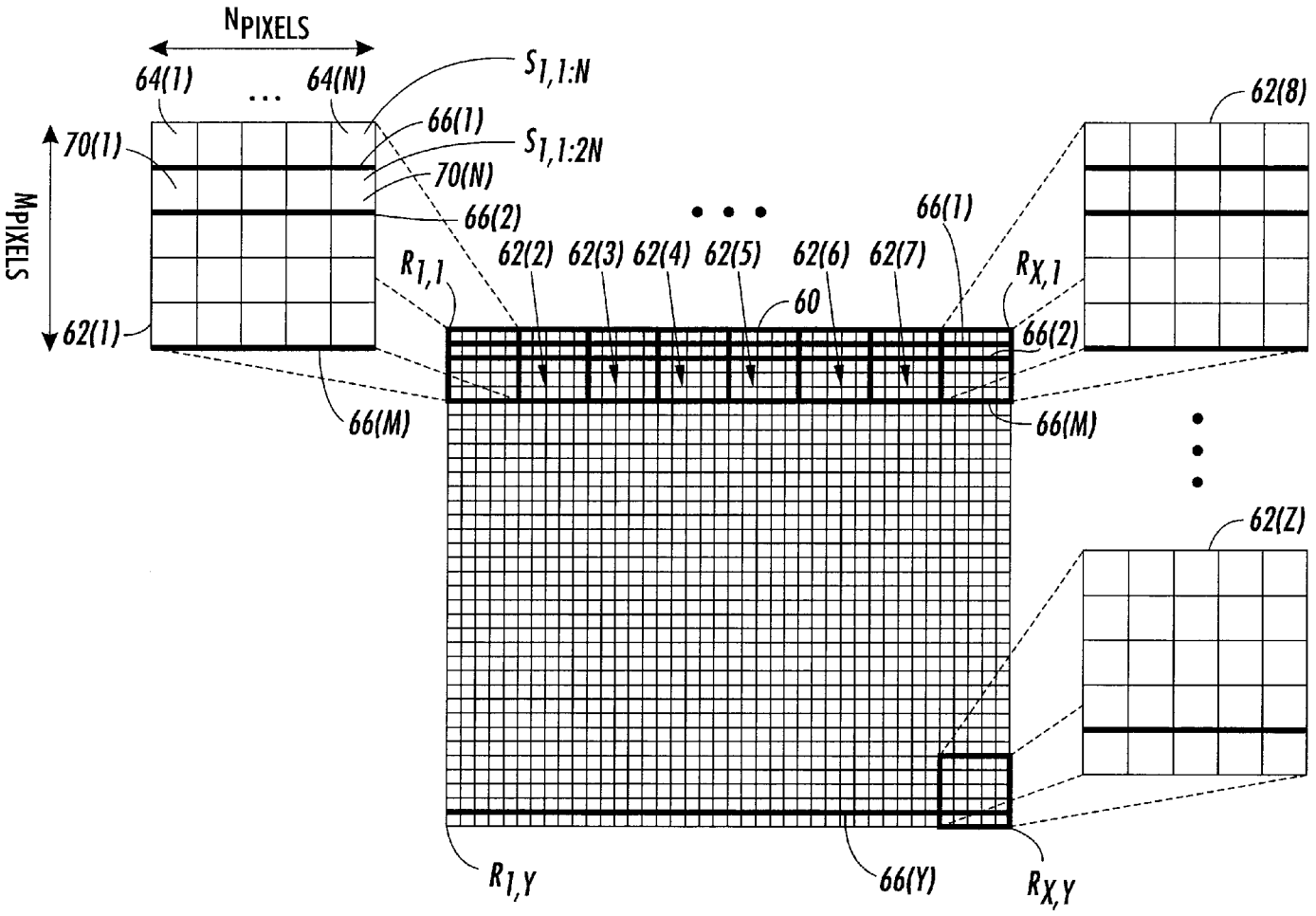
FIG. 6 is a diagram showing an exemplary photoreceptor divided into contone tile regions.

To explain a typical operation of this exemplary embodiment, the following simplified description should be considered. Referring to FIG. 6, an image 60 being printed has a quantity of X·Y pixels, where X and Y each may be any value from $0 \leqq 256$, although the values may be greater or lesser. Further, image 60 is divided into one or more contone tiles 62(1)–62(Z). In this embodiment, image 60 may include 144 contone tiles 62(1)–62(Z) along the X axis, and 85 contone tiles 62(1)–62(Z) along the Y axis, although image 60 may include a greater or lesser number thereof. The contone tiles 62(1)–62(Z) in this embodiment are the same size and each include the same number of pixels. Moreover, each of contone tiles 62(1)–62(Z) has a quantity of N·M pixels. As the image 60 is scanned onto a photoreceptor by ROS device 20(1), it is scanned one scan line 66(1)–66(Y) at a time. In this embodiment, scan lines 66(1)–66(Y) each comprise one row of X pixels in the image 60, although it may comprise a greater or lesser number of pixels in other embodiments.

As the magenta image data for each scan line 66(1)–66(Y) is sent to ROS device 20(1), it is also sent to magenta estimation module 22(1), where it is received by adder circuit 28 in pixel accumulator circuit 26. In particular, if pixel 64(1) in contone tile 62(1) includes a magenta contone, adder circuit 28 increments a magenta contone sum by the value of the contone and stores the result in storage 30(1). As other magenta contones are detected in one or more of pixels 64(2)–64(N) in contone tile 62(1), the previous contone sum value is retrieved from memory 30(1) and is fed back into the adder circuit 28 by the selector unit 32 so that each new contone value is added to the previous sum. The pixel accumulator circuit 26 continues this process until pixel 64(N) has been scanned. The cumulative sum for the first row of pixels (i.e., 64(1)–64(N)) in contone tile 62(1) may be expressed as $S_{1,1:N}$.

At this point, however, selector unit 32 does not feed the contone sum value back to adder circuit 28, but instead outputs the value to storage 30(2), where it is read and stored in RAM 24. Moreover, each time N pixels within each of contone tiles 62(1)–62(Z) have been scanned, the contone sum value is output to storage 30(2) and stored in RAM 24. Pixel accumulator circuit 26 repeats the same process described above for contone tiles 62(2)–62(8) along the X axis of image 60 until the end of the scan line 66(1) is reached at pixel $R_{1,X}$.

Adder circuit 28 eventually receives image data for the second scan line 66(2) in contone tile 62(1). At this point, the value of all the contones present in pixels 64(1)–64(n) represented as $S_{1,1:N}$ are preloaded into the selector unit 32 by the quantizer circuit 34. The contones present in pixels 70(1)–70(n) are summed with the initial contone sum value $S_{1,1:N}$. The new contone sum value for contone tile 62(1) may be represented as $S_{1,1:2N}$. The processes described above are repeated until all of the contones in contone tile 62(1) have been scanned and summed with a final value that may be expressed as $S_{1,1:MN}$. The sum of all the contones detected in each of contone tiles 62(1)–62(8) along the X axis of image 60 at scan line 66(M) is stored in RAM 24 as an array of 32-bit sums. Further, the pixel accumulator circuit 26 repeats the above described processes until all of the contones in the other contone tiles 62(9)–62(Z) in the image 60 have been scanned and summed.

Referring back to FIG. 5, at step 52, magenta FFPC estimation module 20(1) uses quantizer circuit 34 to apply the magenta estimation equation to compensate for color occlusions in the accumulated number of magenta contones determined in step 50 as described further herein. The quantizer circuit 34 stores partial contone counts in RAM 24, quantizes contone tiles 62(1)–62(Z), applies the magenta estimation algorithm, retrieves estimate data for yellow and black contone colors stored in RAM 24, and packs the new estimate in RAM 22 as described further herein. After scan lines 66(1)–66(M) in contone tile 62(1) have been evaluated, for example, values output at storage 30(2) are no longer passed directly to the packer unit 46. Instead, the magenta contone count is converted to an area coverage by multiplying the sum of magenta contones in contone tile 62(1) by an appropriate magenta σ factor as described in the estimation equations further herein below.

As mentioned earlier, the adverse effects caused by improper toner concentration levels are compounded by the IOI interactions of different toner colors in the printed images. With IOI xerography, successive color-plane images (e.g., magenta, yellow, cyan and black) are sequentially applied on a xerographic photoreceptor, each superimposed upon the other, where the application of each separation involves charging, exposing, and developing the image (i.e., applying toner). Thus, for each image separation applied after the first, there is occlusion, or attenuation, of the image exposure in all local areas where prior image applications were developed. Thus, for these occluded areas, less toner of the current separation is used than would be predicted by simple summation of the exposure pixels (i.e., "turned on" pixels) in the separation.

To aid understanding, a simple example is given, followed by more rigorous equations to predict the actual toner consumption. For example, if it were intended to produce a "mustard" color consisting of 50% black and 50% yellow blended in an image region, and black were applied first using 50% halftone screens for each statistically, half of the yellow pixels would be exposed over the black, hence occluded and not developed. Therefore, simple summation of yellow image pixels would predict almost twice the amount of yellow toner than actually consumed in the area, because no other color can develop directly over the black toner. The same problem exists for the magenta and cyan colors as well and is compounded by the fact that these toners are only partially opaque, hence producing only partial occlusion and attenuation of successively applied colors. Therefore, for example, the developability of the magenta color on the yellow color is different than the developability of the magenta color on a bare photoreceptor. Similarly, the developability of the cyan separation on the magenta separation, the cyan separation on the yellow separation, the cyan separation on the magenta separation, and the yellow separation and the cyan separation on a bare photoreceptor are all different. Hence, the CMY pixel counts can not be used directly to accurately calculate their respective toner usages.

Therefore, in this embodiment, magenta, yellow, cyan and black contone counts for a particular image may be denoted by m, y, c, and k respectively. Moreover, M, Y, C and K are the respective actual toner mass consumption for areas of coverage for each color contone image. In this example, σ's are constants that convert pixel counts for a contone image color into an actual average toner mass consumption per exposed pixel. The image path system 10, using quantizer circuit 34 in estimation modules 22(1)–22(4), each find the values of M, Y, C, and K given m, y, c, and k values. For example, in the case where each contone color is printed separately (i.e., not using IOI printing), the pixel count is directly proportional to the actual area covered as shown below:

$$M=m*\sigma_m;$$

$$Y=y*\sigma_y;$$

$$C=c*\sigma_c;$$

and $$K=k*\sigma_k.$$

In IOI printing, however, the relationships shown above do not exist. But given m, y, c, and k, the expected value of M, Y, C and K may be calculated if the universe of all possible documents that may give rise to pixel counts of m, y, c, and k are considered, assuming that all of these documents are equally likely to give rise to such counts (i.e., that they are all distributed uniformly). Thus, for an IOI color xerographic printer, where the sequential order of color application is K, Y, M, C, for example, the expected toner mass consumption for area coverages E, per image separation, computed generally for all documents printed are:

$$E(K)=k*\sigma_k;$$

$$E(Y)=y*\sigma_y-k*y*\sigma_{k\cdot\sigma y};$$

$$E(M)=m*\sigma_m*(1-k*\sigma_k)-m*\sigma_m*E(Y)+m*\sigma_m*\delta_{my}*E(Y);$$

and $$E(C)=c*\sigma_c*[1-k*\sigma_k-E(Y)-E(M)+E(Y)*E(M)+\delta_{cy}*E(Y)*(1-E(M))+\delta_{cm}.E(M)*(1-E(Y))+\delta_{cmy}*E(Y)*E(M)].$$

In this example, δmy, δcy, δcm, δcmy are defined as:

δmy=the ratio of magenta toner developed on a yellow layer to magenta applied to bare photoreceptor;

δcy=the ratio of cyan toner developed on a yellow layer to cyan applied to bare photoreceptor;

δcm=the ratio of cyan toner developed on a magenta layer to cyan applied to bare photoreceptor; and δcmy=the ratio of cyan toner developed on a magenta and yellow layer applied to bare photoreceptor.

Note that, for IOI color printers where the sequential order of printing color separations is different than indicated, the symbolic variables in the above specified equations may be suitably interchanged. As an example, IOI printers may print using the M, Y, C and K order mentioned above, where m, m, $\sigma_m$, would be substituted in Eq. 1 above for k, k, $\sigma_k$ respectively, etc. It should be noted that refinements and other modifications to these equations, reflecting more subtle interactions and nuances of the printing technology and art, may be applied, and are within the scope of the present invention. Magenta estimation module 22(1) stores its estimation equation described above in RAM 24, which may be accessed by estimation equation unit 40 as described herein. Thus, as contone tile data is received from accumulator circuit 26 and processed by quantizer 34 as described herein, the actual area coverage for the magenta contones in image 60 is determined by image path system 10.

In this embodiment, the magenta estimation module 22(1) cannot calculate a contone estimate and store the result in RAM 24 due to the inter-dependencies inherent in the ordered sequencing of imaging and developing the printed color toners using the IOI process as described above. In particular, the magenta estimation module 22(1) cannot determine the actual area of coverage for magenta toner in a printed image until the yellow and black estimation equations are applied to the yellow and black contone counts and stored in RAM 24.

In this embodiment, IOI interdependencies create a one image-station delay between adjacent FFPC estimation modules 22(1)–22(4). The relative delay between FFPC estimation modules 22(1)–22(4) may be expressed using W, W-1, W-2, and W-3 to represent image, plate, page, or station, separations for magenta, yellow, cyan and black, respectively. For example, as the magenta estimation module 22(1) calculates an estimate for image W=36, the yellow estimation 22(2) module calculates an estimate for image W=35; the cyan estimation module 22(3) calculates an estimate for image W=34; and the black estimation module 22(4) calculates an estimate for image W=33. Efficient use of RAM 24 and the transfer bus 23 will accommodate communication and delay between each of FFPC estimation modules 22(1)–22(4).

Next at step 54, magenta FFPC estimation module 22(1) generates an interrupt if the number of magenta contones in the printed image as determined by magenta FFPC estimation module 22(1) causes the magenta toner concentration level to reach a low level.

Next at step 56, image path system 10, by way of printer controller 13, replenishes the magenta toner reservoir upon receiving the interrupt from magenta FFPC estimation module 22(1). When the toner consumption estimates for the magenta FFPC estimation module 22(1) exceeds a predetermined threshold, the printer controller 13 is instructed by magenta FFPC module 22(1) to add an amount of magenta toner that is comparable to the amount consumed. Printer controller 13 then causes a magenta toner dispensing device to dispense enough toner to raise the toner concentration level to an appropriate level.

In other embodiments of the present invention, FFPC estimation modules 22(2)–22(4) each perform steps 50–56 as described above. Moreover, one or more of FFPC estimation modules 22(1)–22(4) may need the estimated contone counts from one or more of FFPC estimation modules 22(1)–22(4). The particular order in which the determinations of the amount of toner used or remaining as well as the reliance on the estimations of one or more of these different colors in the FFPC estimation modules 22(1)–22(4) can vary as needed or desired for the particular application. Additionally, estimation or determination modules for other color schemes, such as for red, green, and blue could also be used. Thus, the image path system 10 containing the FFPC estimation functionality is not limited to determining contone counts and estimating their actual coverage areas in printed images for magenta, yellow, cyan or black color contones only, and is more broadly beneficial to other printers, such as monachrome, "n-colors," xerographic, inkjet and digital offset (i.e., lithographic) presses, for example. Moreover, the present invention, with straightforward variation of form and application, by one skilled in the art, may be generally applied for toner or ink dispensing in any of the various printing systems, technologies methods, and apparatuses mentioned above.

Other modifications of the present invention may occur to those skilled in the art subsequent to a review of the present application, and these modifications, including equivalents thereof, are intended to be included within the scope of the present invention. Further, the recited order of processing elements or sequences, or the use of numbers, letters, or other designations therefor, is not intended to limit the claimed processes to any order except as may be specified in the claims.

What is claimed is:

1. A method for managing replenishment of toners, the method comprising:

determining an area coverage value for each of one or more colors used to create an image to be printed;

compressing the area coverage value for each of the one or more colors;

adjusting at least one of the compressed area coverage values based upon one or more color relationships among the one or more colors; and replenishing one or more of the toners when the adjusted compressed area coverage values for the one or more of the toners indicates a need for replenishment.

2. The method as set forth in claim 1 wherein the determining further comprises:

determining in each of one or more regions in the image a number of pixels printed in each of the one or more colors; and determining the compressed area coverage value for each of the one or more colors based on a total number of the determined number of pixels of each of one or more regions for each of the one or more colors.

3. The method as set forth in claim 2 wherein the printed image has a plurality of the regions.

4. The method as set forth in claim 1 wherein the adjusting further comprises applying one or more estimation equations to each of the compressed area coverage values.

5. The method as set forth in claim 1 wherein the adjusting further comprises applying one or more of:

a black estimation equation to adjust a value representing the compressed area coverage value representing a quantity of black image units;

a yellow estimation equation to adjust the compressed area coverage value representing a quantity of yellow image units, wherein a quantity of black image units is used in the yellow estimation equation;

a magenta estimation equation to adjust the compressed area coverage value representing a quantity of magenta image units, wherein the quantity of black image units and the adjusted quantity of yellow image units are used in applying the magenta estimation equation; or a cyan estimation equation to adjust the compressed area coverage value representing a quantity of cyan image units, wherein the quantity of black image units, the adjusted quantity of yellow image units, and the adjusted quantity of magenta image units are used in applying the cyan estimation equation.

6. The method as set forth in claim 5 wherein the black estimation equation comprises $E(K)=k*\sigma_k$, the yellow estimation equation comprises $E(Y)=y*\sigma_y-k*y*\sigma_k*\sigma_y$, the magenta estimation equation comprises $E(M)=m*\sigma_m*(1-k*\sigma_k)-m*\sigma_m*E(Y)+m*\sigma_m*\delta_{my}*E(Y)$, and the cyan estimation equation comprises $E(C)=c*\sigma_c*[1-k*\sigma_k-E(Y)-E(M)+E(Y)*E(M)+\mathbf{67}_{cy}*E(Y)*(1-E(M))+\delta_{cm}*E(M)*(1-E(Y))+\delta_{cmy}*E(Y)*E(M)]$, wherein $\sigma_k$ comprises a constant that converts a black image unit total into an actual black toner mass consumption value, $\sigma_y$ comprises a constant that converts a yellow image unit total into an actual yellow toner mass consumption value, $\sigma_m$ comprises a constant that converts a magenta image unit total into an actual magenta toner mass consumption value, $\sigma_c$ comprises a constant that converts a cyan image unit total into an actual cyan toner mass consumption value, $\delta_{my}$ comprises a ratio of magenta toner developed on a yellow layer to the magenta toner applied to the bare photoreceptor, $\delta_{cy}$ comprises a ratio of cyan toner developed on the yellow layer to the cyan toner applied to the bare photoreceptor, $\delta_{cm}$ comprises the ratio of the cyan toner developed on a magenta layer to the cyan toner applied to the bare photoreceptor, $\delta_{cmy}$ comprises the ratio of cyan toner developed on the magenta layer and the yellow layer applied to the bare photoreceptor, m comprises a magenta contone count, y comprises a yellow contone count, c comprises a cyan contone count, and k comprises a black contone count.

7. The method as set forth in claim 1 wherein the adjusting further comprises adjusting the compressed area coverage value for one of the one or more colors by using results obtained from applying one or more color estimation equations associated with the one or more colors to adjust the compressed area coverage value for the one color.

8. The method as set forth in claim 1 wherein the replenishing further comprises:

determining when the adjusted compressed area coverage value for the one or more of the toners is greater than a threshold quantity for the corresponding one of the one or more colors.

9. The method as set forth in claim 8 further comprising generating an interrupt when the adjusted compressed area coverage value for the one or more of the toners is determined to be greater than the threshold quantity.

10. The method as set forth in claim 1 wherein the one or more colors comprise magenta, yellow, cyan and black.

11. The method as set forth in claim 1 wherein the one or more colors comprise red, green and blue.

12. The method as set forth in claim 1 wherein the one or more colors comprise black, gray and white.

13. The method as set forth in claim 1 further comprising packing the compressed area coverage values into one combined data stream.

14. The method as set forth in claim 1 wherein the relationships among the one or more colors comprise effects of image-on-image color occlusions which result if the image to be printed is printed using unadjusted area coverage values of the one or more colors.

15. A system for managing replenishment of toners, the system comprising:

an image unit counting system that determines an area coverage value for each of one or more colors used to create an image to be printed;

a quantizing system that compresses the area coverage value for each of the one or more colors;

an adjustment system that adjusts at least one of the compressed area coverage values based upon one or more color relationships among the one or more colors; and a replenishment system that replenishes one or more of the toners when the adjusted compressed area coverage values for the one or more of the toners indicates a need for replenishment.

16. The system as set forth in claim 15 wherein the image unit counting system further comprises a pixel counting system that determines in each of one or more regions in the image a number of pixels printed in each of the one or more colors, wherein the pixel counting system determines the quantity of image units for each of the one or more colors based on a total number of the determined number of pixels of each of the one or more colors for each of one or more regions.

17. The system as set forth in claim 16 wherein the printed image has a plurality of the regions.

18. The system as set forth in claim 15 wherein the adjustment system applies one or more estimation equations to each of the compressed area coverage values.

19. The system as set forth in claim 15 wherein the adjustment system applies one or more of a black estimation equation to adjust the compressed area coverage value representing a quantity of black image units, a yellow estimation equation to adjust the compressed area coverage value representing a quantity of yellow image units, wherein the quantity of black image units is used in the yellow estimation equation, a magenta estimation equation to adjust the compressed area coverage value representing a quantity of magenta image units, wherein the quantity of black image units and the adjusted quantity of yellow image units are used in applying the magenta estimation equation, a cyan estimation equation to adjust the compressed area coverage value representing a quantity of cyan image units, wherein the quantity of black image units, the adjusted quantity of yellow image units, and the adjusted quantity of magenta image units are used in applying the cyan estimation equation.

20. The system as set forth in claim 19 wherein the black estimation equation comprises $E(K)=k*\sigma_k$, the yellow estimation equation comprises $E(Y)=y*\sigma_y-k*y*\sigma_k*\sigma_y$, the magenta estimation equation comprises $E(M)=m*\sigma_m*(1-k*\sigma_k)-m*\sigma_m*E(Y)+m*\sigma_m*\delta_{my}*E(Y)$, and the cyan estimation equation comprises $E(C)=c*\sigma_c*[1-k*\sigma_k-E(Y)-E(M)+E(Y)*E(M)+\delta_{cy}*E(Y)*(1-E(M))+\delta_{cm}*E(M)*(1-E(Y))+\delta_{cmy}*E(Y)*E(M)]$, wherein $\sigma_k$ comprises a constant that converts a black image unit total into an actual black toner mass consumption value, $\sigma_y$ comprises a constant that converts a yellow image unit total into an actual yellow toner mass consumption value, $\sigma_m$ comprises a constant that converts a magenta image unit total into an actual magenta toner mass consumption value, $\sigma_c$ comprises a constant that converts a cyan image unit total into an actual cyan toner mass consumption value, $\delta_{my}$ comprises a ratio of magenta toner developed on a yellow layer to the magenta toner applied to the bare photoreceptor, $\delta_{cy}$ comprises a ratio of cyan toner developed on the yellow layer to the cyan toner applied to the bare photoreceptor, $\delta_{cm}$ comprises the ratio of the cyan toner developed on a magenta layer to the cyan toner applied to the bare photoreceptor, $\delta_{cmy}$ comprises the ratio of cyan toner developed on the magenta layer and the yellow layer applied to the bare photoreceptor, m comprises a magenta contone count, y comprises a yellow contone count, c comprises a cyan contone count, and k comprises a black contone count.

21. The system as set forth in claim 15 wherein the adjustment system adjusts the compressed area coverage value for one of the one or more colors by using results obtained from applying one or more color estimation equations associated with the one or more colors to adjust the compressed area coverage value for the one color.

22. The system as set forth in claim 15 wherein the replenishment system determines when the adjusted compressed area coverage value for the one or more of the toners is greater than a threshold quantity for the corresponding one of the one or more colors.

23. The system as set forth in claim 22 wherein the replenishment system generates an interrupt when the adjusted compressed area coverage value for the one or more of the toners is determined to be greater than the threshold quantity.

24. The system as set forth in claim 15 wherein the one or more colors comprise magenta, yellow, cyan and black.

25. The system as set forth in claim 15 wherein the one or more colors comprise red, green and blue.

26. The system as set forth in claim 15 wherein the one or more colors comprise black, gray or white.

27. The system as set forth in claim 15 wherein the compression system further comprises a barrel shifter.

28. The system as set forth in claim 15 wherein the compression system further comprises a packer unit that packs the compressed area coverage values into one combined data stream.

29. The system as set forth in claim 15 wherein the relationships among the one or more colors comprise effects of image-on-image color occlusions which result if the image to be printed is printed using unadjusted area coverage values of the one or more colors.

* * * * *